US006647569B1

(12) United States Patent
Tansek

(10) Patent No.: US 6,647,569 B1
(45) Date of Patent: Nov. 18, 2003

(54) STRESSABLE FABRIC

(76) Inventor: Dave Tansek, 425 Allegan Cir., San Jose, CA (US) 95123

( * ) Notice: Subject to any disclaimer, the term of this patent is extended or adjusted under 35 U.S.C. 154(b) by 28 days.

(21) Appl. No.: 10/016,804

(22) Filed: Dec. 6, 2001

(51) Int. Cl.[7] ..... A47C 27/00

(52) U.S. Cl. ..... 5/186.1; 5/690; 5/701; 5/400; 2/455; 2/413; 267/143

(58) Field of Search ..... 5/186.1, 400, 188, 5/401, 239, 240, 690, 719, 728, 701, 682, 683; 267/117, 142, 143; 2/455, 413

(56) References Cited

U.S. PATENT DOCUMENTS 4,122,568 A * 10/1978 Bastos et al. ..... 5/690
4,370,767 A * 2/1983 Fraser ..... 5/417
5,369,826 A * 12/1994 Ikeda ..... 5/613
5,377,369 A * 1/1995 Shirai ..... 5/236.1
5,448,789 A * 9/1995 Shirai ..... 5/613

* cited by examiner

*Primary Examiner*—Michael F. Trettel
(74) *Attorney, Agent, or Firm*—The Kline Law Firm

(57) ABSTRACT

A stressable fabric that includes a plurality of layers of multiple materials. A top layer is formed from a generally non-elastic material. Suitable materials for the top layer are fibers, cables, woven material, or any other material that will bend when stress is applied, but that will not stretch. The top layer is attached to a motion axis defining layer made from a plurality of non-compressible blocks. The non-compressible blocks may be rectangular, oval, or other shapes depending on the requirements of a specific application. The shape of the non-compressible blocks defines the directions in which the stressable fabric can easily move. The non-compressible blocks of the motion axis defining layer are separated by a compressible interstitial element. The degree of compressibility of the compressible interstitial element is also varied according to the product design requirements.

21 Claims, 6 Drawing Sheets

STRESSABLE FABRIC

BACKGROUND OF THE INVENTION

1. Field of the Invention

The present invention relates generally to shock absorbing and protective materials, and more particularly is a material that limits or eliminates displacement in one direction, while freely allowing displacement in other directions.

2. Description of the Prior Art

Throughout history, man has recognized a need for protective clothing and equipment. The earliest examples of protective clothing were for military purposes—protecting warriors during hand-to-hand combat. While current day usages have expanded to include protective clothing and devices for on-the-job and recreational activities, the basis premise remains the same. The devices must provide the user protection, while at the same time affording mobility.

A constant balancing of requirements must be applied when designing protective devices. A rigid device ill most likely provide the best protection, but it will also almost certainly be very restrictive of the user's mobility. Conversely, flexible devices allow a greater range of motion, but may not provide sufficient protection against impact and/or motion outside a safe range. An everyday example of this dilemma can be seen by considering a very common piece of equipment, a knee brace. An elasticized sleeve will provide some support to the knee while allowing the user to maintain a full range of motion, and therefore maintain speed and agility. However, an elasticized sleeve will not protect against an impact, nor will it provide sufficient support for a damaged knee. A knee brace with plastic stays provides greater support and can be effective for compensating for minor injuries, but the rigidity of the device begins to affect the wearer's mobility. Braces with metal stays and supports clearly provide the greatest support, and best protection against impact. However, these braces can significantly affect the user's mobility Accordingly, it is an object of the present invention to provide a fabric that can be used to construct protective equipment and clothing that provides significant support and impact protection, while minimizing any restriction of the user's movement.

It is a further object of the present invention to provide a material that can be used to construct a supporting surface, such as a bed or a tabletop, that will resist force in one direction, but will be completely movable in a second direction to allow complete collapsing for storage and transport.

It is a still further object of the present invention to provide a material that will have a variable and controllable level of resistance to movement in a given direction.

SUMMARY OF THE INVENTION

The present invention is a stressable fabric. As related to the present invention, "stressable fabric" is defined to mean a material that will limit movement in a given direction, but that will freely allow movement in at least one other direction.

The stressable fabric of the present invention is comprised of layers of multiple materials. A top layer s formed from a generally non-elastic material. Suitable materials for the top layer are fibers, cables, woven material, or any other material that will bend when stress is applied, but that will not stretch. The top layer is attached to a motion axis defining layer comprised of a plurality of non-compressible blocks. The non-compressible blocks may be rectangular, oval, or other shapes depending on the requirements of a specific application. The shape of the non-compressible blocks defines the directions in which the stressable fabric can easily move. The non-compressible block of the motion axis defining layer are separated by a compressible interstitial element. The degree of compressibility of the compressible interstitial element is also varied according to the product design requirements.

The stressable fabric of the present invention, in addition to having varying degrees of displacement limitation, can of course also be made in any size required for a given application. This adaptability gives the stressable fabric a broad range of practical applications. Protective clothing is of course a major use for the stressable fabric. But a user can just as easily use stressable fabric to construct a bed that is thin, lightweight, and that can be rolled up for storage and transport. The stressable fabric of the present invention an also be used for medical purposes, such as bandages that restrict certain motions only. The stressable fabric can also be beneficially used for protective sporting gear.

An advantage o the present invention is that the stressable fabric resists displacement in a first direction, but freely allows motion in at least one other direction. In the case of protective clothing, this characteristic allows the construction of garments that will effectively resist an impact, but will allow free movement by the wearer.

Another advantage of the present invention is that the range and direction of the restricted motion can be defined by the construction parameters of the stressable fabric.

A still further advantage of the present invention is that it can be used in a myriad of applications, thereby enjoying significant economic viability.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
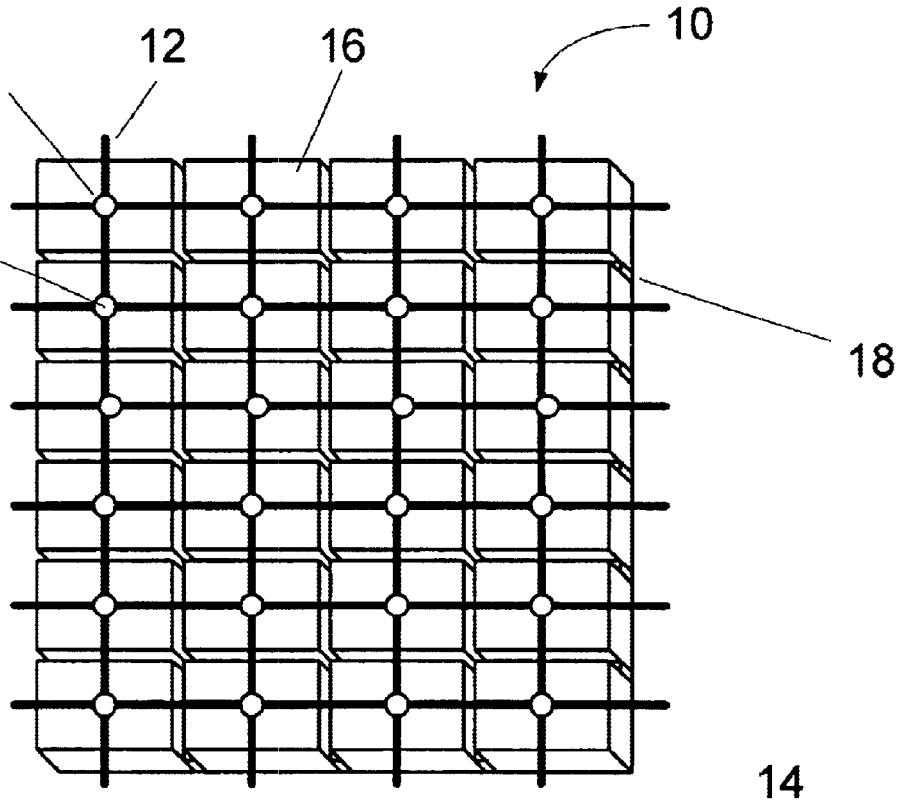
FIG. 1 is a perspective view of a stressable fabric formed according to the present invention.
Figure 2:
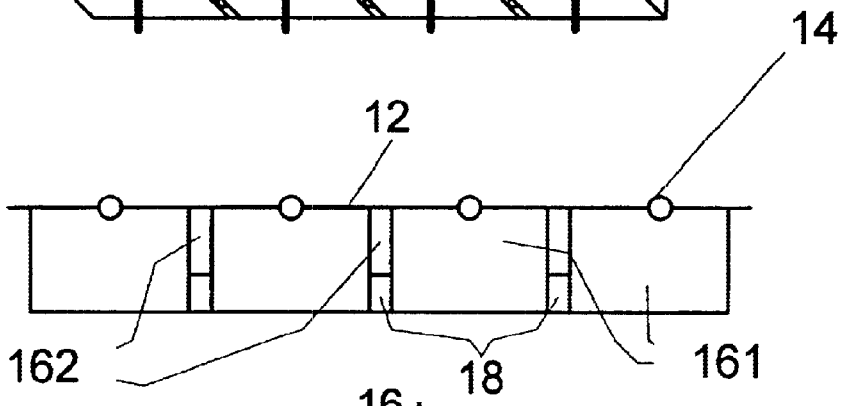
FIG. 2 is a side view of the stressable fabric.
Figure 3:
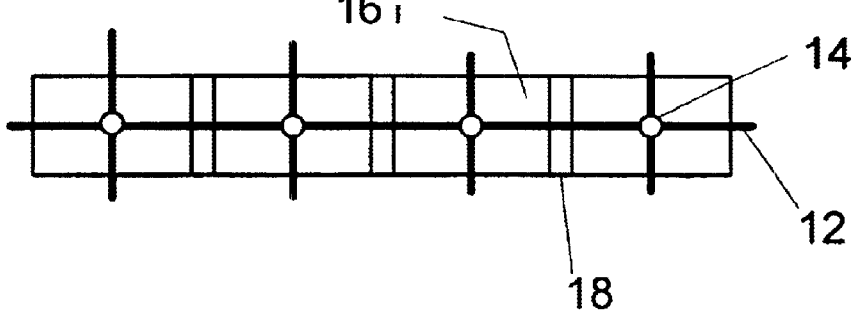
FIG. 3 is a top view of the stressable fabric.

Referring first to FIGS. 1–3, the present invention is stressable fabric 10 comprised of at least two layers of materials. A top layer 12 is formed from a flexible but non-stretching material. Materials suitable for construction of the top layer 12 are fibers, cables, and woven material. The chief requirement for the material that forms the top layer 12 is that it must a low the top layer 12 to bend when stress is applied, and it must not stretch so that the top layer 12 will return to an original position when the stress force is removed.

The top layer 12 is secured at multiple attachment points 14 to a motion axis defining layer 16. The attachment points 14 can be formed with either a mechanical attachment means, such as clips or ties, or the top layer 12 may be attached to the motion axis defining layer 16 by adhesives.

The motion axis defining layer 16 is formed from a plurality of non-compressible blocks 161. The non-compressible blocks 161 may be rectangular, oval, or other shapes depending on the requirements of the application in which the stressable fabric 10 is being used. The shape of the non-compressible blocks 161 defines the direction or directions in which the stressable fabric 10 can easily move.

The non-compressible blocks 161 of the motion axis defining layer 16 are separated by a compressible interstitial element 18. The degree of compressibility of the compressible interstitial element 18 is also varied according to the product design requirements, i.e. applications calling for greater flexibility will use an interstitial element with a greater degree of compressibility.

Figure 4:
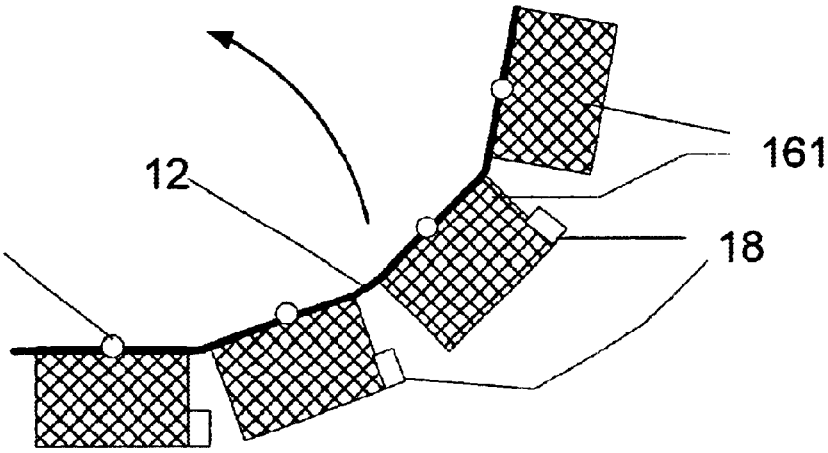
FIG. 4 is a side view of the stressable fabric as force is applied in the direction in which displacement is allowed.
Figure 5:
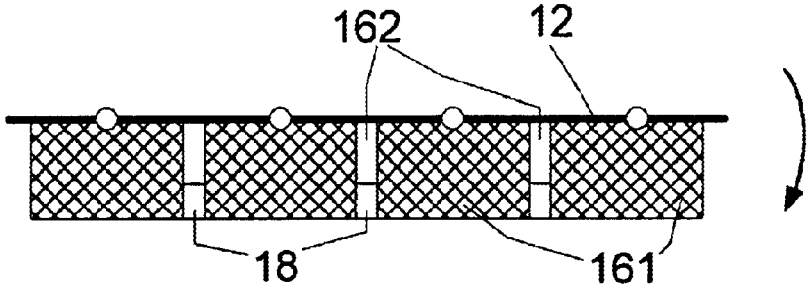
FIG. 5 is a side view of the stressable fabric as force is applied in the direction in which displacement is resisted.
Figure 6:
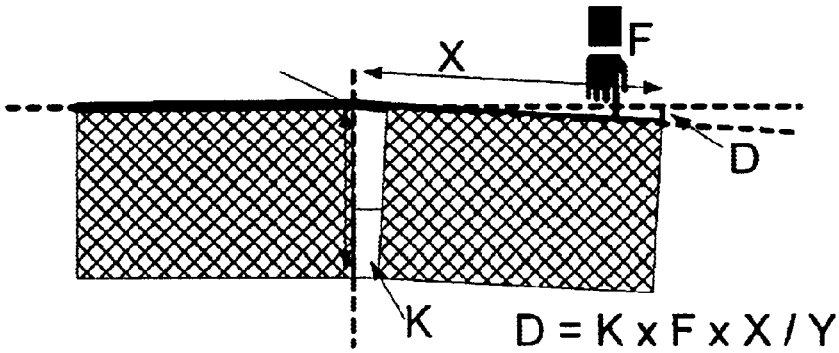
FIG. 6 illustrates the method of calculating the amount of displacement that will be allowed under force applied to the compressible interstitial material.

Please refer now to FIGS. 4–7, which illustrate the limiting function of the motion axis defining layer 16. The shape of the non-compressible blocks 161 forming the motion axis defining layer 16 of the fabric 10 determines the directional limitation of flexibility. FIGS. 4 and 5 show the motion limiting effect of a stressable fabric 10 made with square or rectangular blocks 161. When a force is applied from the underside of the fabric 10, as depict d in FIG. 4, the fabric rotates easily. The spaces 162 between the blocks 161 allow the fabric 10 to flex easily toward the top layer 12. Conversely, when a force is applied to the top side of the fabric 10, as in FIG. 5, the fabric 10 resists any deformation.

The amount of deflection of the fabric is a function of the material used as the compressible interstitial material 18. Within the limits of the resistance of the compressible interstitial material 18, the amount of deflection D caused by a force F applied to the top side of he fabric 10 is defined by the equation $D=K\times F\times X/Y$, where X is the length of the block 161 plus the space 162, Y is the thickness of the block 161, and K is the compressibility constant of the compressible interstitial material 18. If the force F is strong enough o completely overcome the resistance of the interstitial material 18, D is then defined by the width of space 162 only. To make a flexible stressable fabric 10, a flexible interstitial material 18 is chosen. To make a more rigid stressable fabric 18, a stiffer interstitial material 18 is used.

Figure 7A:
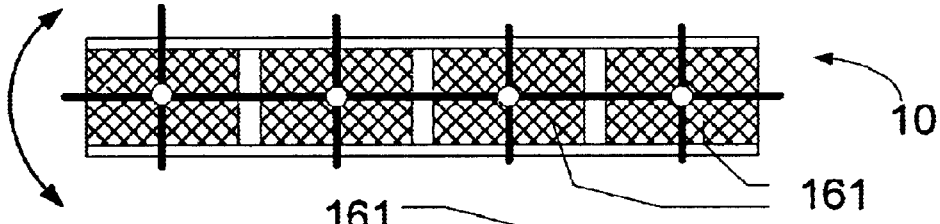
FIG. 7 is a top view of two stressable fabrics, one with oval non-compressible blocks and one with square non-compressible blocks.
Figure 7B:
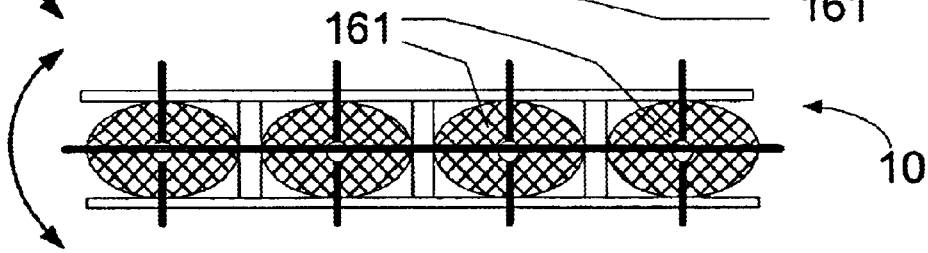

FIGS. 7*a* and 7*b* illustrate the effect of choosing different shapes for the non-compressible blocks of the motion axis defining layer 16. FIG. 7*a* shows a stressable fabric 10 form ed with a motion axis defining layer 16 formed from rectangular blocks 161. As the motion arrows indicate, rotational forces about the longitudinal axis shown are resisted by the contact of the corners of the blocks 161 with the interstitial elements 18. This is n contrast to the situation illustrated in FIG. 7*b*, where the stressable fabric 10' is formed with oval blocks 161'. When the oval blocks 161' are utilized, the rounded shoulders of the blocks 161' cause a gap to be formed between the block 161' and the interstitial element 18. Therefore, when the same rotational force that is resisted by the structure shown in FIG. 7*a* is applied to the structure in FIG. 7*b*, the fabric 10' shown in FIG. 7*b* is easily moved until the block 161' contacts the interstitial element 18. Thus the axes of motion and the range of motion of the stressable fabric is defined and limited by the geometry of the blocks chosen to form the motion axis defining layer 16.

Figure 8:
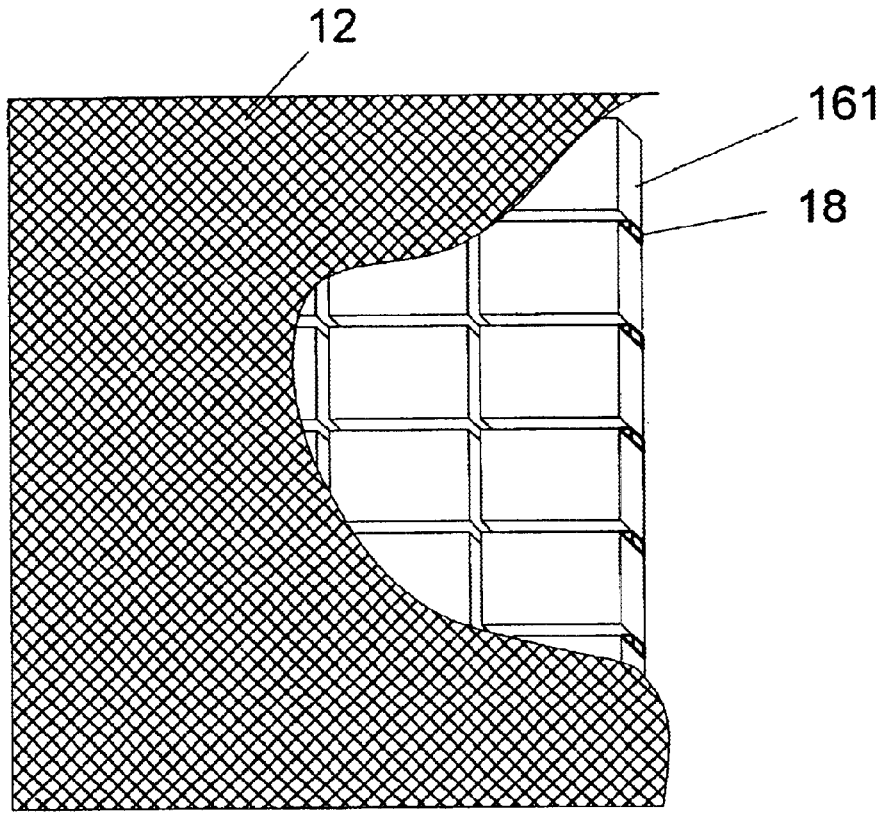
FIG. 8 is a partially broken view of a stressable fabric with a solid top layer.
Figure 9:
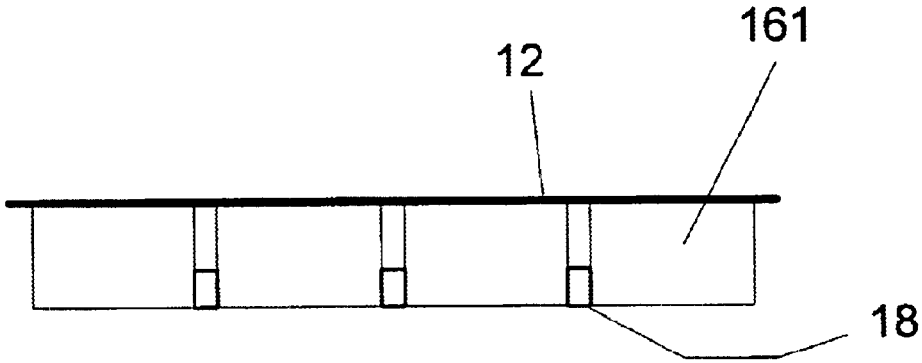
FIG. 9 is a side view of the non-compressible blocks of the stressable fabric illustrated in FIG. 8.

Once the axes of motion are defined by the choice of the geometry of the blocks, the flexibility of the fabric can be modified by the choice of material to serve as the compressible interstitial element 18. Typically, the compressible interstitial element 18 will be a deformable solid, such as rubber, as shown in FIGS. 8 and 9. The interstitial elements 18 are attached to one of each pair of adjacent blocks 161. This enables the blocks to remain in their proper position when the fabric 10 is flexed in the direction or directions in which motion is freely allowed.

Figure 10:
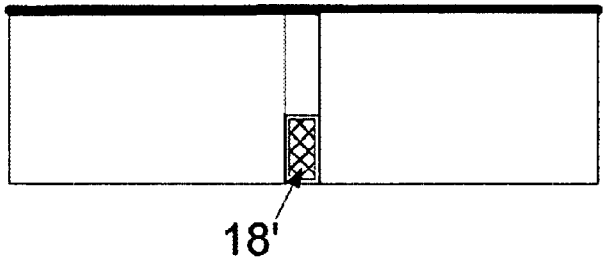
FIG. 10 shows a means to provide variable compressibility of an interstitial material element.
Figure 11:
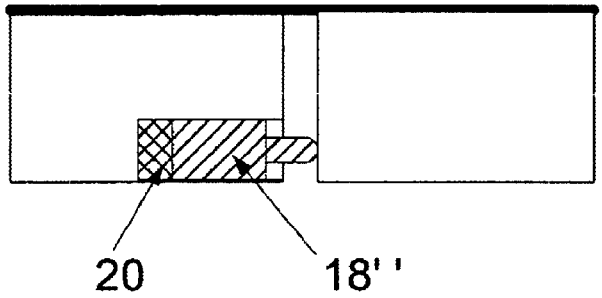
FIG. 11 shows another means of varying compressibility of an interstitial element.
Figure 12:
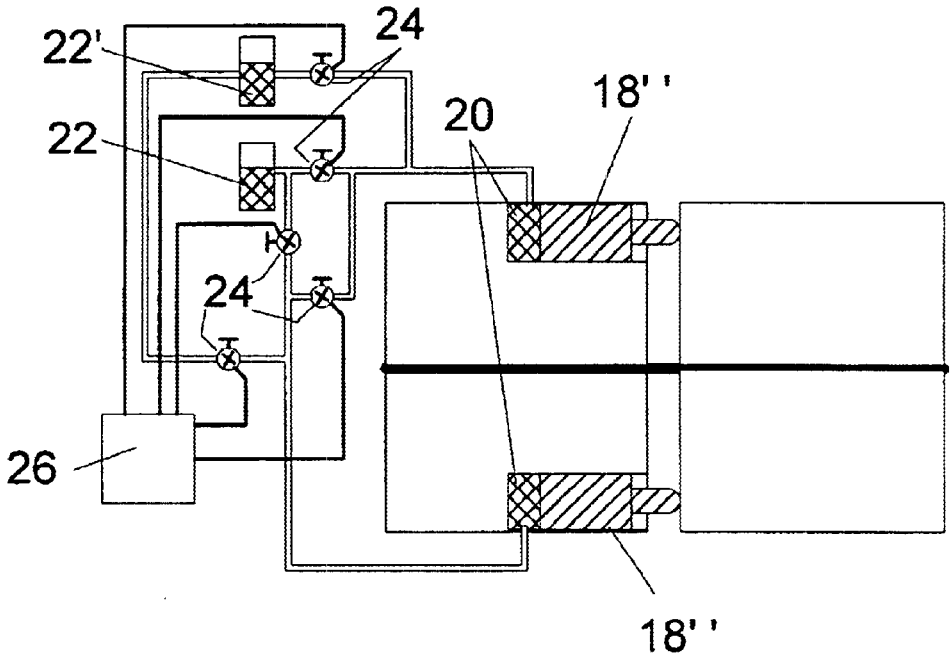
FIG. 12 illustrates a method of varying resistance across a surface of stressable fabric using interstitial elements with varying compressibility.
Figure 13:
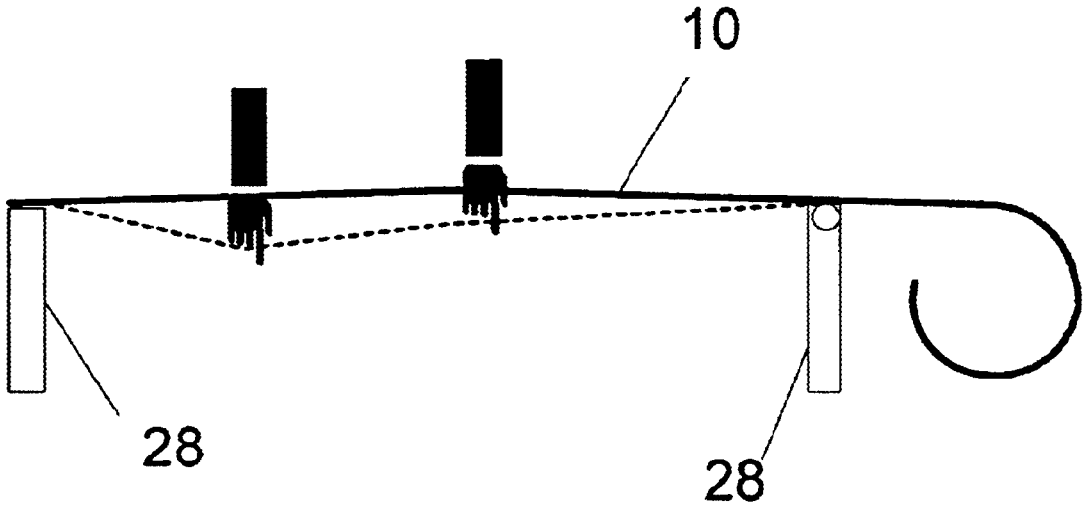
FIG. 13 illustrates the stressable fabric of the present invention used to make a portable bed.

FIGS. 10–12 illustrate other methods of shock absorption than can be used to form the compressible interstitial elements 18. In FIG. 10, the interstitial elements are fluid filled tubes 18'. The flexibility of the stressable fabric can be controlled by varying the rigidity of the tubes, and the amount of fluid in the tubes. It will be recognized by those skilled in the art that nearly any method of shock absorption can be adapted to be used to form the compressible interstitial elements of the present invention.

FIG. 11 illustrates a stressable fabric 10 in which the compressible interstitial elements 18 are mechanical plungers 18". The fluid 20 in the base of the plunger 18" is typically vented to a common holding tank 22. Pressure is introduced to the system by a pressure source 22', a pump. The plungers 18" can also include valves 24 so that the fabric 10 can be dynamically pressurized or vented by an external control mechanism 26. The plungers 18" can also be in communication with each other. The external control mechanism 26 allows the user to flex the fabric 10 and control the stiffness. If the fluid 20 is not compressible, and the level of the fluid is increased to a point where the tip of the plunger 18" is in contact with an adjacent block 161, then the fabric will become rigid in an axis in which it was formerly freely movable. FIG. 12 illustrates a situation in which a plurality of plungers 18" are utilized in the stressable fabric 10. With this confirmation, the external control mechanism 26 can vary the fluid level in the plungers 18' to control the flexibility of the fabric 10. The fluid levels can also be varied so that the material 10 is dynamically bent.

Examples of uses of the stressable fabric 10 of the present invention are shown in FIGS. 13–17. The stressable fabric 10 can be used to form a portable bed by simply mounting a sheet of the fabric 10 on support structures 28. The stiffness of the mattress can be controlled by varying the shapes of the non-compressible blocks 161 and/or the compressibility of the interstitial elements 18. If the multiple plunger 18" arrangement shown in FIG. 12 is utilized, and if the plungers 18" are vented to each other so that the fluid 20 can move freely between adjacent plungers 18", the fabric 10 will dynamically adjust to distribute the forces on it. In other words, the bed formed from stressable fabric 10, although only requiring about an inch of thickness of material, will behave exactly like a water bed This compact structure allows the bed to be easily rolled up for storage and transportation.

Figure 14:
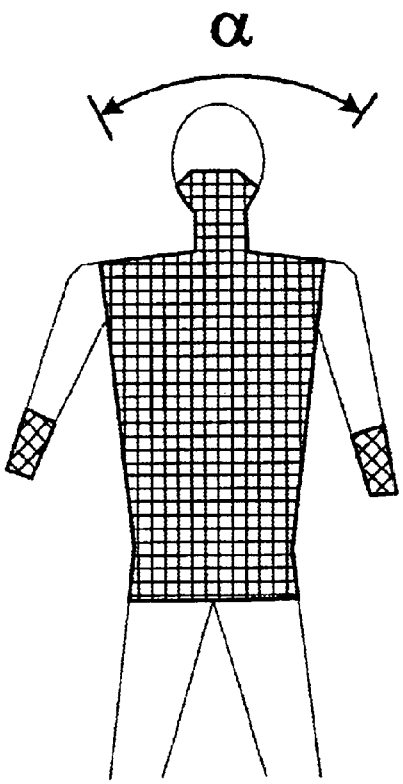
FIGS. 14–16 show protective clothing formed from stressable fabric.
Figure 15:
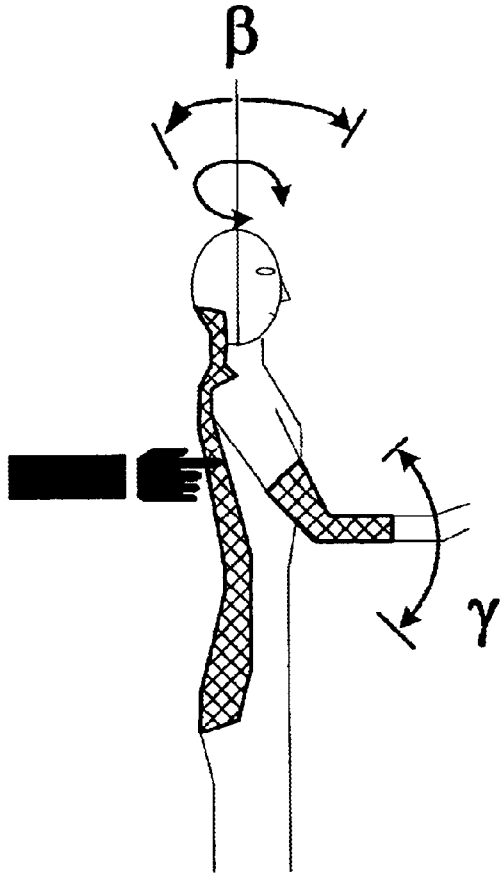
Figure 16:
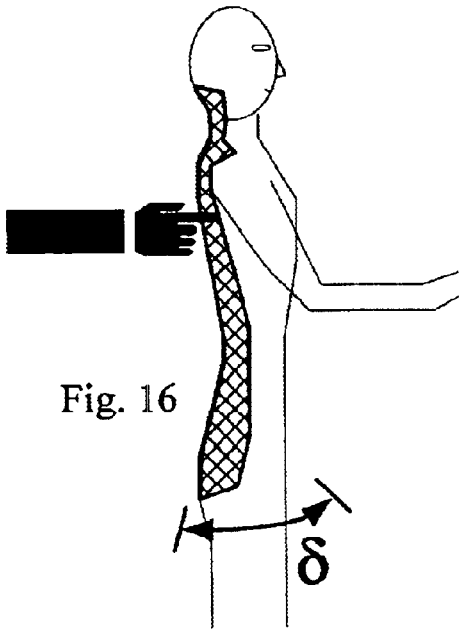

FIGS. 14–16 illustrate various applications of the stressable fabric 10 as protective clothing. The fabric will in all applications be impact resistant due to the motion resistance and the ability of the fabric to distribute forces across the surface of the fabric. The fabric can be contoured to a user's body, and can be designed to limit motions in chosen axes. As shown in FIG. 14, a garment covering the neck and lower head of the user can be constructed so that side-to-side movement of the user's head is possible only within a defined arc α. FIG. 15 illustrates the same garment used to allow easy rotational movement of the head, but to restrict forward and back motion within arc β. FIG. 15 also depicts a protective elbow brace that limits the movement of the user's arm within an arc y. FIG. 16 shows that the protective garment can also be used to restrict the motion of the pelvis and lower back of the user within an arc δ.

The stressable fabric of the present invention can also be used for medical purposes, such as bandages that restrict certain motions only. The stressable fabric can also be beneficially used for protective sporting gear.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A stressable fabric comprising:

a plurality of layers of materials, a first layer comprising a flexible material, and a second layer comprising a plurality of non-compressible blocks spaced slightly apart, said non-compressible blocks being oval cylinders, and said first layer being attached to one side of said second layer; such that said fabric is highly resistant to a force applied toward and generally perpendicular to an outer plane of said first layer, said force causing said non-compressible blocks to contact each other and to resist said force applied to said first layer, and said fabric bends easily in response to forces applied from other directions, such that said fabric twists, bends, and flexes in response to movement of a wearer.

2. The stressable fabric defined in claim 1 wherein:

said non-compressible blocks are rectangular blocks.

3. The stressable fabric defined in claim 1 wherein:

spacing between said non-compressible blocks is varied so that said fabric forms a non-planar surface.

4. The stressable fabric defined in claim 1 wherein:

an interstitial element is inserted between said non-compressible blocks of said second layer, said interstitial element being compressible so that rigidity of said fabric is reduced.

5. The stressable fabric defined in claim 4 wherein:

said interstitial element comprises at least one vessel that receives a fluid.

6. The stressable fabric defined in claim 5 wherein:

said vessel comprises a plunger, a base of said vessel contacting a first one of said non-compressible blocks, and a distal end of said plunger contacting a second adjacent one of said non-compressible blocks.

7. The stressable fabric defined in claim 4 wherein:

said interstitial element comprises a plurality of vessels that receive a fluid.

8. The stressable fabric defined in claim 7 wherein:

each of said vessels comprises a plunger, a base of each said vessel contacting a first one of said non-compressible blocks, and a distal end of each said plunger contacting a second adjacent one of said non-compressible blocks.

9. The stressable fabric defined in claim 7 wherein:

a level of said fluid in said vessels is controlled by an external control mechanism.

10. The stressable fabric defined in claim 7 wherein:

said vessels are all in communication with a common holding tank.

11. The stressable fabric defined in claim 7 wherein:

each of said vessels is in communication with at least a second one of said vessels.

12. A stressable fabric comprising:

a plurality of layers of materials, a first layer comprising a flexible material, and a second layer comprising a plurality of non-compressible blocks spaced slightly apart, said first layer being attached to one side of said second layer; such that said fabric is highly resistant to a force applied toward and generally perpendicular to an outer plane of said first layer, said force causing said non-compressible blocks to contact each other and to resist said force applied to said first layer, and said fabric bends easily in response to forces applied from other directions, such that said fabric twists, bends, and flexes in response to movement of a wearer; wherein an interstitial element comprising at least one vessel that receives a fluid is inserted between said non-compressible blocks of said second layer, said interstitial element being compressible so that rigidity of said fabric is reduced.

13. The stressable fabric defined in claim 12 wherein:

said non-compressible blocks are rectangular blocks.

14. The stressable fabric defined in claim 12 wherein:

said non-compressible blocks are oval cylinders.

15. The stressable fabric defined in claim 12 wherein:

spacing between said non-compressible blocks is varied so that said fabric forms a non-planar surface.

16. The stressable fabric defined in claim 12 wherein:

said vessel comprises a plunger, a base of said vessel contacting a first one of said non-compressible blocks, and a distal end of said plunger contacting a second adjacent one of said non-compressible blocks.

17. The stressable fabric defined in claim 12 wherein:

said interstitial element comprises a plurality of vessels that receive a fluid.

18. The stressable fabric defined in claim 17 wherein:

each of said vessels comprises a plunger, a base of each said vessel contacting a first one of said non-compressible blocks, and a distal end of each said plunger contacting a second adjacent one of said non-compressible blocks.

19. The stressable fabric defined in claim 17 wherein:

a level of said fluid: in said vessels is controlled by an external control mechanism.

20. The stressable fabric defined in claim 17 wherein:

said vessels are all in communication with a common holding tank.

21. The stressable fabric defined in claim 17 wherein:

each of said vessels is in communication with at least a second one of said vessels.

* * * * *